US008016699B1

(12) United States Patent
Swartzendruber

(10) Patent No.: US 8,016,699 B1
(45) Date of Patent: Sep. 13, 2011

(54) BASEBALL PITCH STOP WITH BALL RETURN

(76) Inventor: Rodney Swartzendruber, Bay Port, MI (US)

( * ) Notice: Subject to any disclaimer, the term of this patent is extended or adjusted under 35 U.S.C. 154(b) by 0 days.

(21) Appl. No.: 12/653,246

(22) Filed: Dec. 11, 2009

(51) Int. Cl.
*A63B 69/00* (2006.01)

(52) U.S. Cl. ..... 473/431; 473/451; 473/432

(58) Field of Classification Search ..... 473/431, 473/451, 432, 460, 436; D21/698
See application file for complete search history.

(56) References Cited

U.S. PATENT DOCUMENTS

| | | | | | |
|---|---|---|---|---|---|
| 1,043,308 | A * | 11/1912 | Everson | 473/432 |
| 2,082,818 | A * | 6/1937 | Atwell | 473/436 |
| 4,883,272 | A * | 11/1989 | Lay | 473/436 |
| 4,974,843 | A * | 12/1990 | Henningsson | 473/431 |
| 5,160,131 | A * | 11/1992 | Leon | 473/451 |
| 5,485,994 | A * | 1/1996 | Underwood et al. | 473/451 |
| 5,746,670 | A * | 5/1998 | Brady | 473/451 |
| 5,823,894 | A * | 10/1998 | Actor | 473/422 |
| 6,155,936 | A * | 12/2000 | Dorr | 473/456 |
| 6,379,272 | B1 * | 4/2002 | Gorgo et al. | 473/421 |
| 6,620,064 | B2 * | 9/2003 | Nickerson | 473/431 |
| 7,066,845 | B2 * | 6/2006 | Joseph | 473/431 |
| 7,137,910 | B2 * | 11/2006 | Ktson et al. | 473/431 |
| 7,156,761 | B2 * | 1/2007 | Mesa | 473/451 |
| 7,278,934 | B2 * | 10/2007 | McBride et al. | 473/451 |
| 7,399,241 | B1 * | 7/2008 | Thomas, Sr. | 473/455 |
| 7,662,053 | B1 * | 2/2010 | Summers et al. | 473/431 |
| D624,976 | S * | 10/2010 | McBride et al. | D21/698 |

* cited by examiner

*Primary Examiner* — Mitra Aryanpour
(74) *Attorney, Agent, or Firm* — Robert L. McKellar; McKellar IP Law, PLLC

(57) ABSTRACT

An air driven ball return pitching apparatus that is unique in that the motor, when activated creates a vacuum zone on part of the system and a pressurized zone on the remainder of the system. The motor housing is equipped with a blower that acts upon the system through a Y connection in the pipe. When activated the blower forces air into the pressurized zone and creates the vacuum in that zone. The ball is pitched at the target of the back stop; the ball falls to the bottom which is graded to direct the ball to the return system. The vacuum acts upon the ball causing it to enter the return system and travel to the motor housing where it switches zones into the pressurized zone returning the ball to the pitching position for reuse.

9 Claims, 5 Drawing Sheets

BASEBALL PITCH STOP WITH BALL RETURN

BACKGROUND OF THE INVENTION

The idea of baseball pitch stop with ball returns is not new to the art. However, the combination of a pitch stop and a vacuum ball return that will return the ball to the user exactly where they have released the pitch from is new and unique.

THE INVENTION

The instant invention is an air driven ball return pitching apparatus comprising in combination; a back stop, ball return and support apparatus. This support apparatus has a top bar, a bottom bar and two side supports that are all attached to each other to form a self-standing frame or back stop.

A receiving net suspended within and affixed to the self standing frame. The air driven ball return pitching apparatus also features a receiver box that has a front wall, two end walls and a bottom. This bottom is compiled from at least a front section and a back section and both have outside and inside edges. The inside edges interface each other and are lower relative to the outside edges. The back section has an opening therein extending from near the lower edge to near the upper edge, and located in the opening there is a receiver pipe for balls. The receiver pipe is comprised of pipe sections aligned with each other to form an incipient continuous pipe that exits the bottom and attached thereto, a 90° angled pipe, and a second straight pipe that exceeds one-half the width of the support apparatus in length. The straight pipe connection to a second 90° angled pipe and a second straight pipe that is coupled to a Y-pipe. This Y-pipe is connected to a predetermined length of a third straight pipe that has a distal end. This third straight pipe culminates at an elevated level at the distal end. The Y of the Y-pipe is fitted with a motor capable of being powered which is positioned in the Y of the Y-pipe to advance pressured air, when operating, towards the distal end of the third straight pipe and simultaneously creates a vacuum on the incipient continuous pipe, such that balls pitched into the receiving net, that are collected by the bottom are returned to the distal end of the third straight pipe.

DETAILED DESCRIPTION OF THE DRAWINGS

Figure 1:
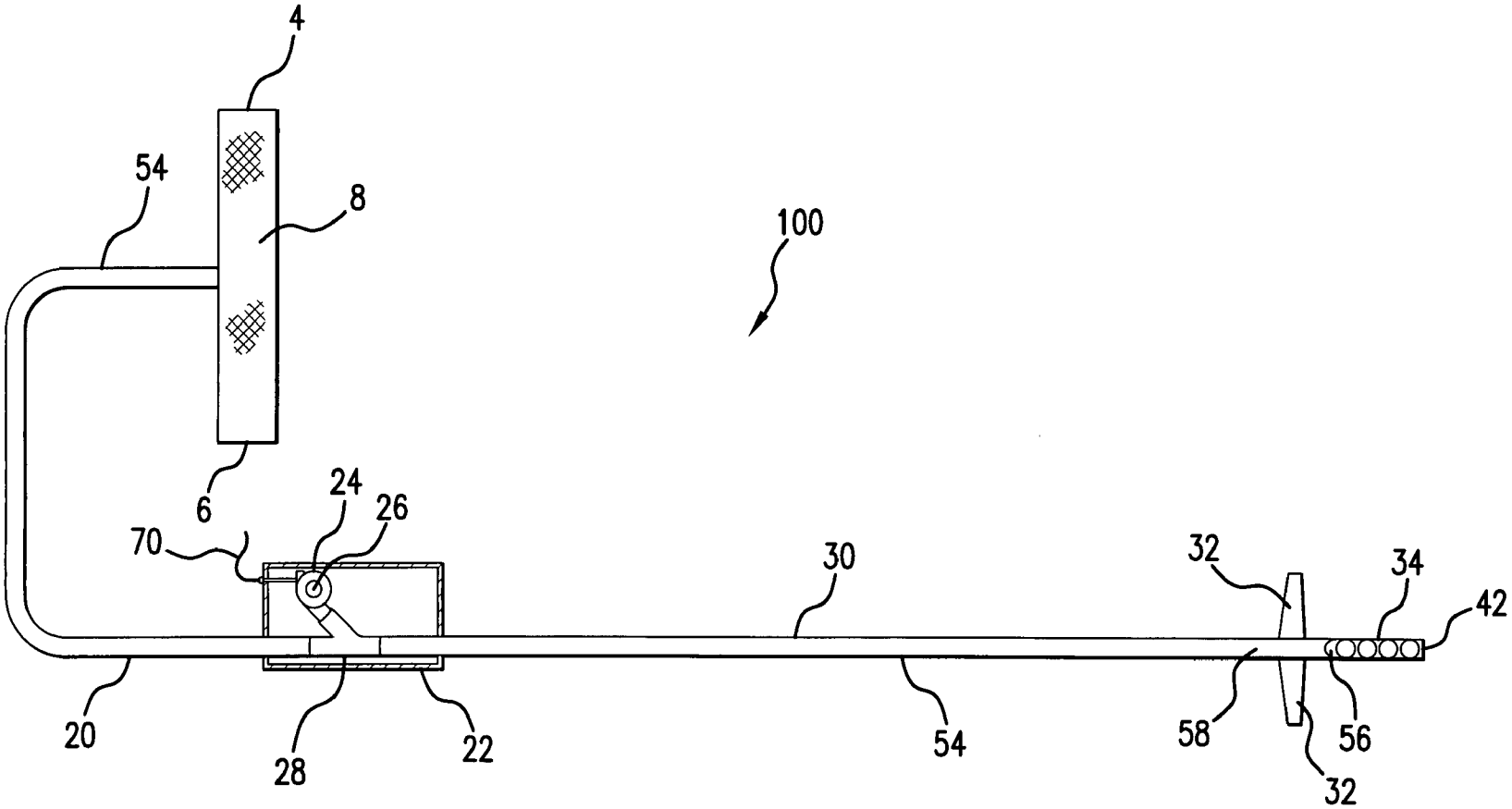
FIG. 1 is a top view of the pitch return device showing the entire apparatus.

FIG. 1 is a top view of the pitch return device 100 showing the entire apparatus. The back stop 2 has a first side 4 and a second side 6. Also visible is the top side 8 of the backstop 2. Not visible from this perspective is the bottom side 10. When the ball is pitched into the backstop 2 its progress is stopped and the ball falls to the bottom side 10 and is directed into an area that further directs the ball to a return hole 18 (not shown). The ball is drawn into the ball return hole via the vacuum induced on the return pipe 54. The first section of the return pipe 54 is known as the vacuum zone 20. This section has a vacuum induced upon it via the blower 26. The blower 26 is located within the blower housing 22. The motor 24 is electrically charged and operates the blower 26. The blower 26 is connected to a Y connector 28. When the motor 24 is running the blower 26 forces air into the Y connector and it forces air out of the second section of the return pipe 54 or the pressurized zone 30. This zone 30 of the return pipe 54 being pressurized induces a vacuum on the first section, the vacuum zone 20, and draws the balls into the return pipe 54 at the ball return hole 18 and delivering the ball eventually to the distal end 42 of the pressurized zone 30 of the return pipe 54. The distal end 42 of the pressurized zone 30 of the return pipe 54 is elevated by a pipe stand 32. In the distal end 42 there is a section of the return pipe 54 where there is an elongated opening 56 on the top surface 58 of the pipe 54 that serves as a ball coral 34.

Figure 2:
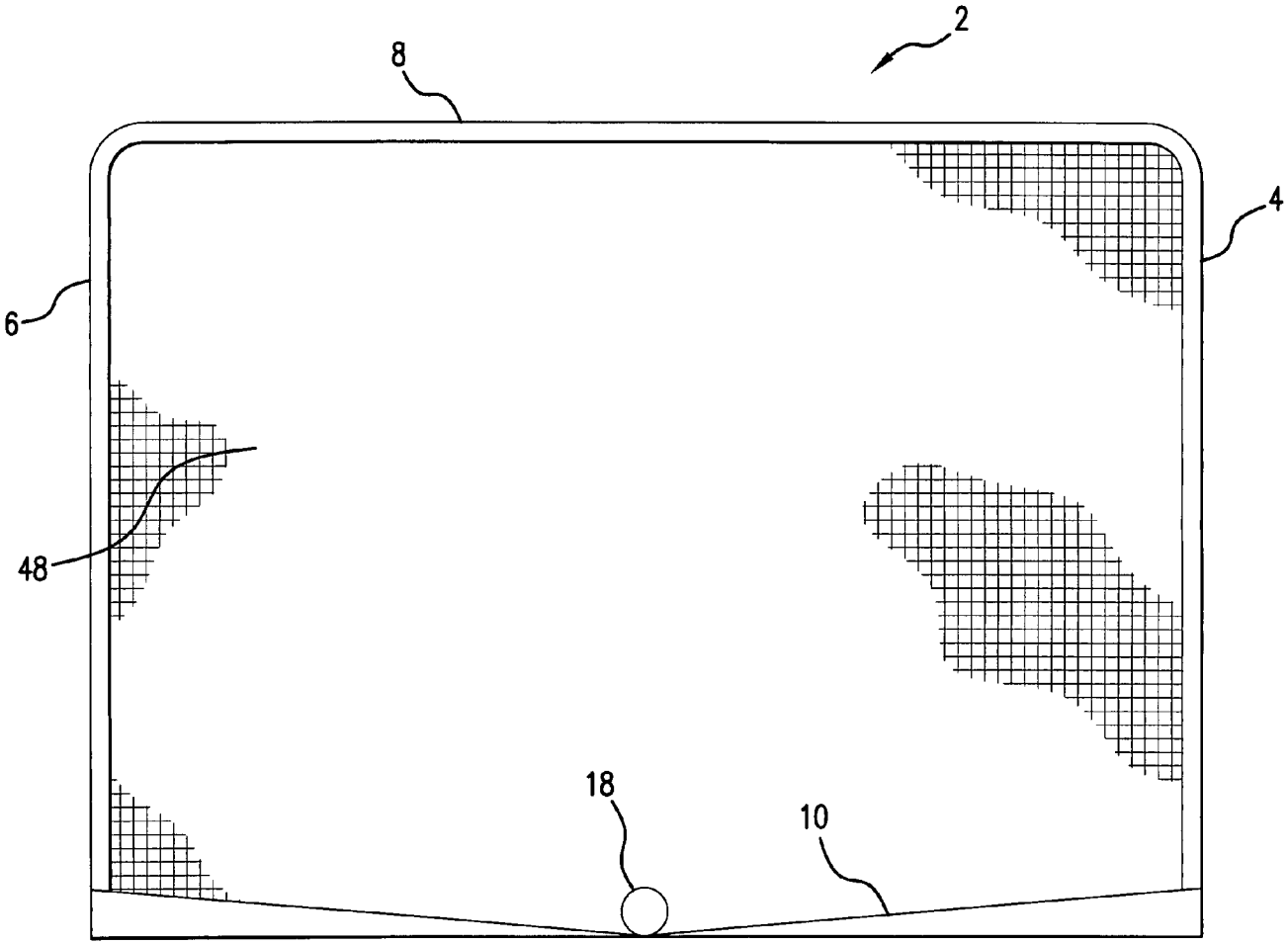
FIG. 2 is a full frontal view of the pitch return back stop and bottom section.

FIG. 2 is a full frontal view of the pitch return device 100, the backstop 2 and bottom section 10. The back stop 2 has a first side 4, a second side 6, a top side 8 and a bottom side 10. The netting 48 of the backstop 2 spans the area between the top side 8, the bottom side 10, the first side 4 and the second side 8 forming a barrier to the pitch balls or a receiver. This barrier will stop the forward progression of the pitched ball and drop it downwardly to be collected by the bottom side 10 and directed to the ball return hole 18.

Figure 3:
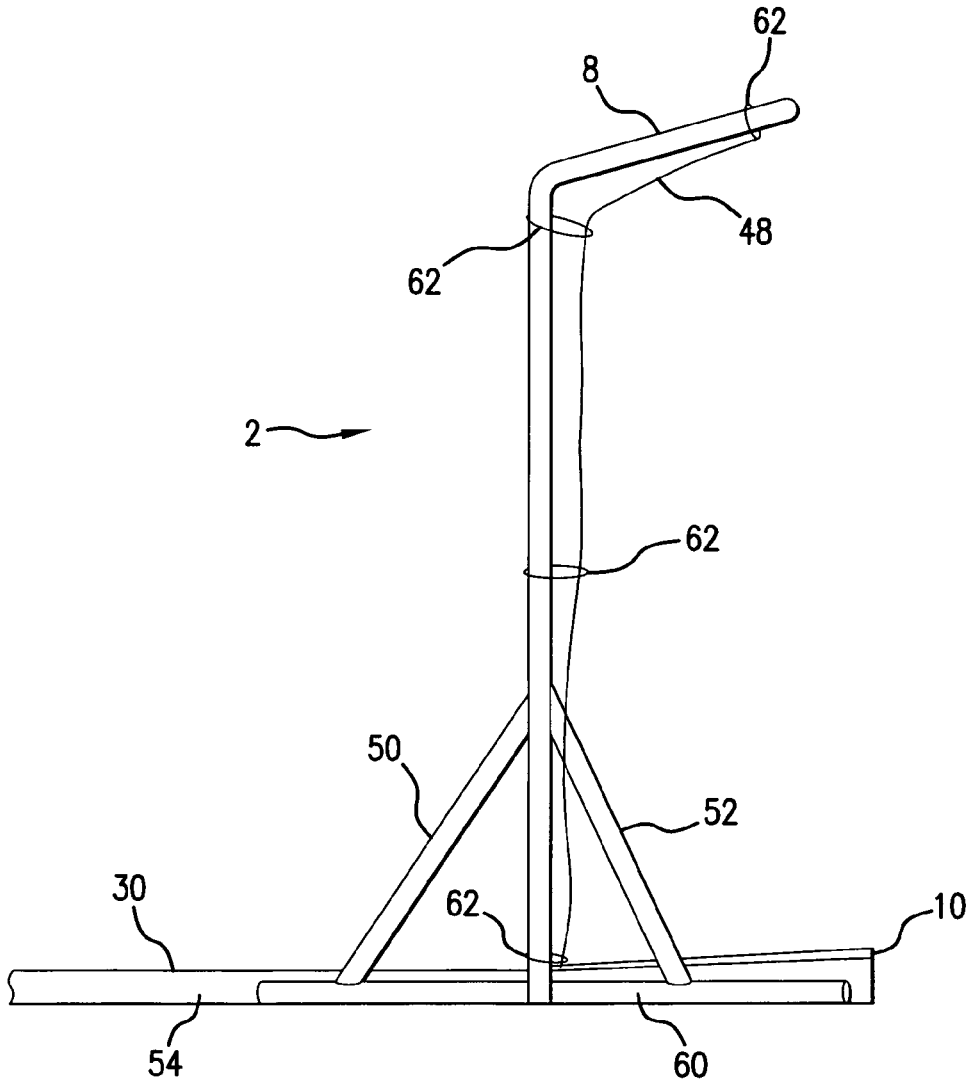
FIG. 3 is a side view of the back stop featuring the net assembly and relationship of the bottom and vacuum return line.

FIG. 3 is a side view of the back stop 2 featuring the netting 48 and relationship of the bottom 10 and vacuum zone 30 of the return line 54. The second side 6 of the back stop 2 is supported by first side supports 50, the second side supports 52 and support base 60. It should be noted that the first side 4 of the back stop 2 is configured in the same manner as shown here concerning the second side 6. The netting 48 is secured to the backstop 2 from the top 8, along the second side 6 until the bottom 10. It is secured periodically with fasteners 62.

Figure 4:
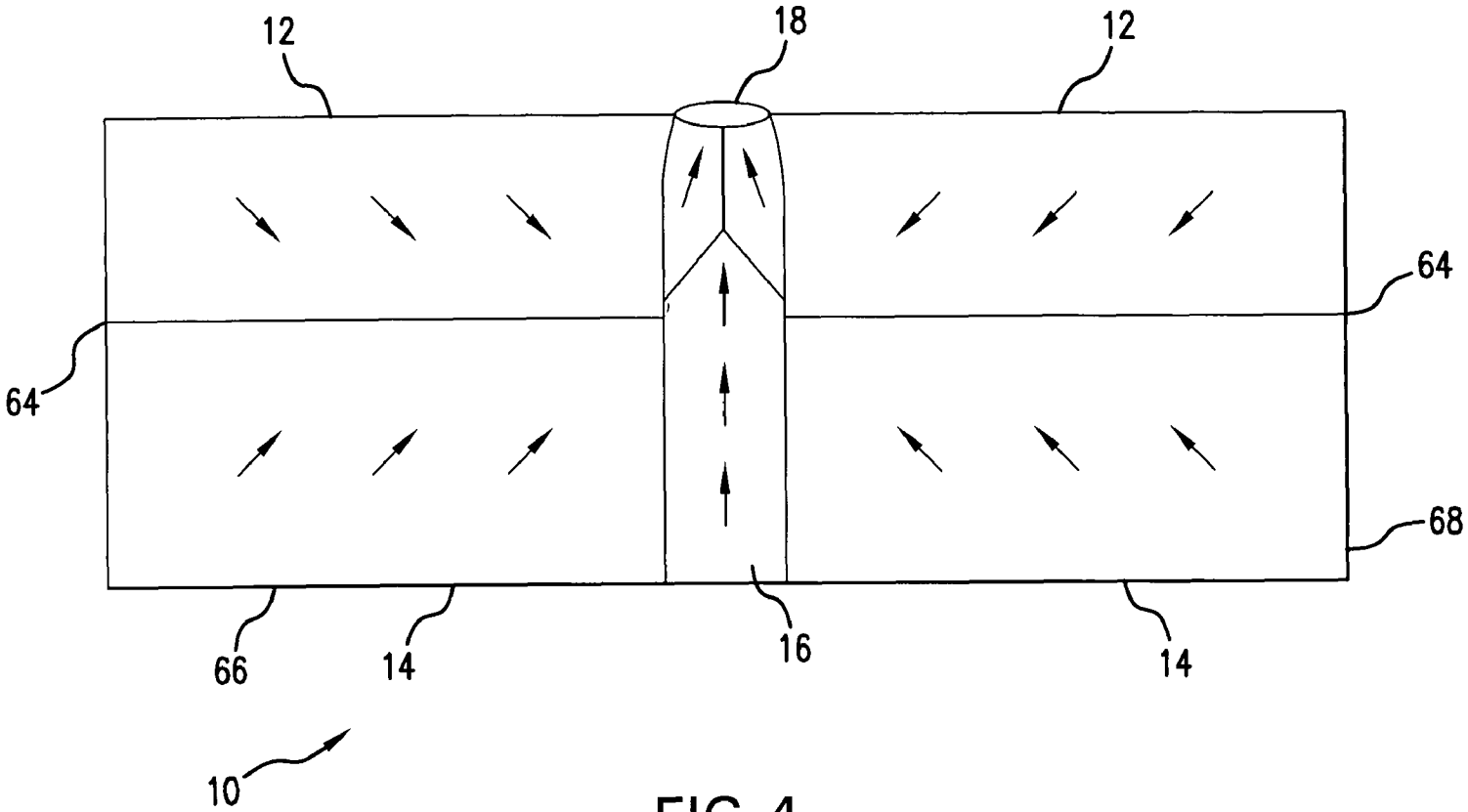
FIG. 4 is a top view of the bottom with different elevations present.

FIG. 4 is a top view of the bottom 10 with different elevations present. When the ball is pitched as the backstop 2 and hits the netting 48 its progression is stopped and the ball falls downwardly. The ball hits the bottom 10 and depending on where it falls upon the bottom 10 it will be directed toward the ball return hole 18. This is possible because the bottom 10 has multiple sections that are beveled and will direct the ball accordingly. The first beveled section 12 directs the ball forward toward the middle of the bottom 10. The second beveled section 14 directs the ball backward toward the middle section 64. The terminus of both the forward and backward beveled sections (the first 12 and second beveled sections 14) brings the ball to the middle section 64 of the bottom 10. Each half 66 and 68 of the bottom 10 is formed by its first side 12 and second side 14 coming together. Each half 66 and 68 are identical in numbering. Each half 66 and 68 are also joined together by the third beveled area 16. The ball is directed by one of the two halves 66 or 68, and then further directed to the third beveled section 16. Section 16 is beveled backward terminating into the ball return hole 18. All balls that are directed at the backstop 2 hit the netting 48 then drop the bottom 10 and are directed to the ball return hole 18 and enter the vacuum zone 20 of the return pipe 54. The ball is then drawn into the vacuum zone 20 passing into the pressurized zones 30 and delivered to the ball coral at the distal end 42 of the return pipe 54.

Figure 5:
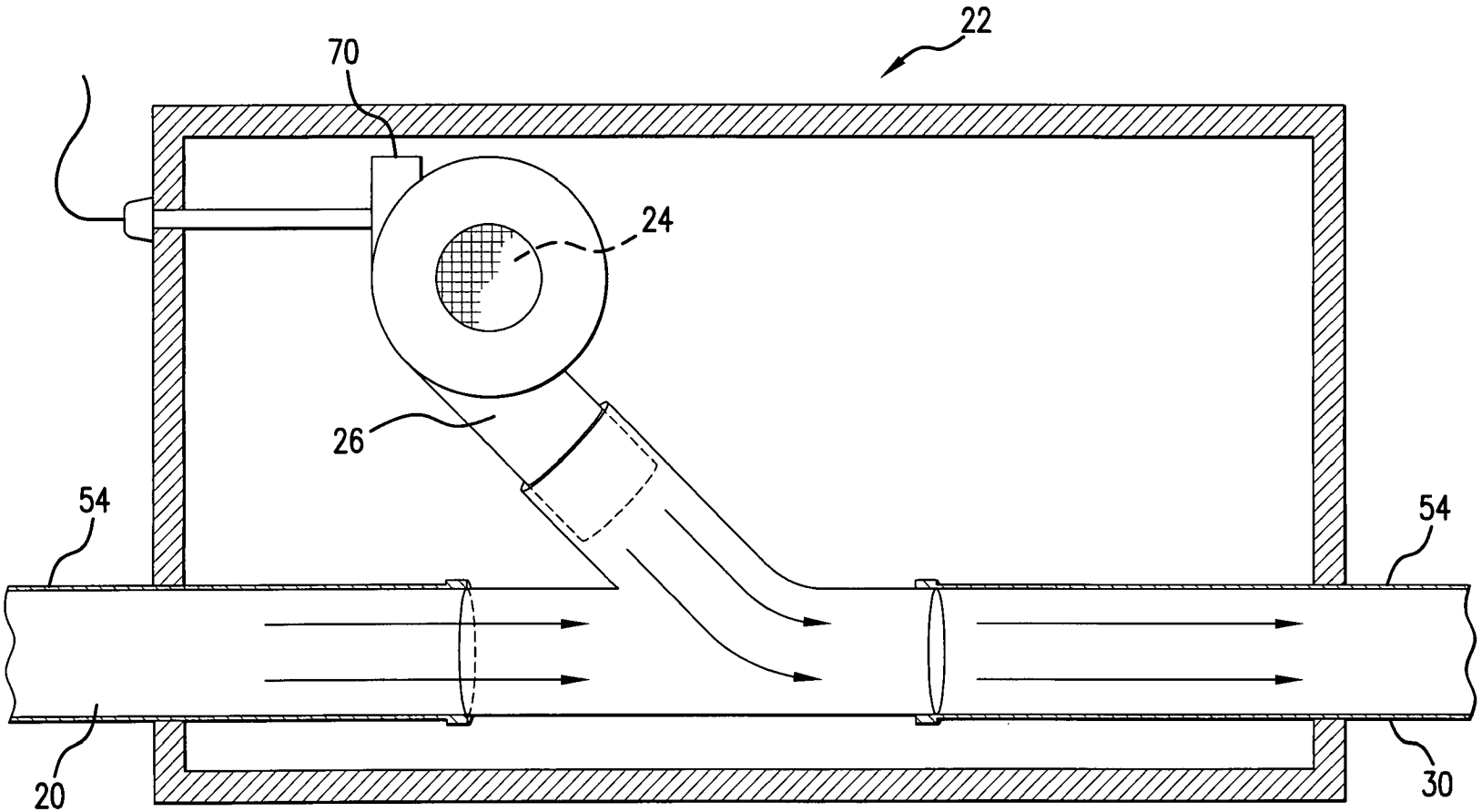
FIG. 5 is an inside view of the blower housing featuring the blower, vacuum zone and pressurized zone.

FIG. 5 is an inside view of the blower housing 22 featuring the blower 26, Y connector 28, vacuum zone 20 and pressurized zone 30. With the electrical power 70 energized the motor 24 activates the blower 26 thus inducing pressure into the Y connection 28 and the pressurized zone 30, while simultaneously creating a vacuum on the vacuum zone 20 of the return pipe 54. This feature is the essence of the invention.

The system can be configured to accommodate soft balls, tennis balls, soccer balls and golf balls.

When used as a pitching backstop the device can be configured to different lengths according to age and distance required for different skill levels. The diameter of the return pipe will vary depending upon what size ball is used in the device. For example the return pipe diameter for baseball is suitable for a baseball return. When a softball is used the pipe diameter reflects the size of the softball. When a golf ball is used the pipe diameter reflects the size of a golf ball. When a soccer ball is used the pipe diameter is used that reflects the size of the soccer ball used, as soccer ball sizes vary depending upon age. When a tennis ball is used the diameter of the pipe reflects that suitable for a tennis ball.

What is claimed is:

1. An air driven ball return pitching apparatus comprising in combination:

i. a support apparatus, said support apparatus having a top bar, a bottom bar and two side supports that are all attached to each other to form a self-standing frame;

ii. a receiving net suspended within and affixed to the self standing frame;

iii. a receiver box having a front wall, two end walls and a bottom, said bottom being compiled from at least a front section and a back section having a lower edge and an upper edge, both having outside edges and inside edges; the inside edges interfacing each other and being lower relative to the outside edges; the back section having an opening therein extending from near the lower edge to near the upper edge; located in said opening, a receiver pipe for balls, said receiver pipe being comprised of pipe sections aligned with each other to form an incipient continuous pipe that exits the bottom and attached thereto, a 90° angled pipe, and a second straight pipe that exceeds one-half the width of the support apparatus in length, said second pipe is connected to a second 90° angled pipe and a said second straight pipe that is coupled to a Y-pipe; the Y-pipe being connected to a predetermined length of a third straight pipe having a distal end; which third straight pipe culminates at an elevated level at the distal end; the Y of the Y-pipe being fitted with a motor capable of being powered which is positioned in the Y of the Y-pipe to advance pressured air, when operating, towards the distal end of the third straight pipe and simultaneously creates a vacuum on the incipient continuous pipe, such that balls pitched into the receiving net, that are collected by the bottom are returned to the distal end of the third straight pipe.

2. An air driven ball return apparatus as claimed in claim 1 wherein, the apparatus is configured to return softballs.

3. An air driven ball return apparatus as claimed in claim 1 wherein, the apparatus is configured to return tennis balls.

4. An air driven ball return apparatus as claimed in claim 1 wherein, the apparatus is configured to return golf balls.

5. An air driven ball return apparatus as claimed in claim 1 wherein, the apparatus is configured to return soccer balls.

6. An air driven ball return apparatus as claimed in claim 1 wherein, all pipe in the apparatus is constructed of polyvinylchloride.

7. An air driven ball return apparatus as claimed in claim 1 wherein, the receiving net is constructed of polyvinylchloride.

8. An air driven ball return apparatus as claimed in claim 1 wherein the length of said receiver pipe, said second straight pipe, said Y-pipe and said third straight pipe is adjustable.

9. An air driven ball return apparatus as claimed in claim 1 wherein diameter of said receiver pipe, said second straight pipe, said Y-pipe and said third straight pipe is predetermined by the diameter of the ball used in the apparatus.

* * * * *